169-43 SR
8/17/76 OR 3,974,879

United States Patent [19]
Nelson, Jr. et al.

[11] 3,974,879
[45] Aug. 17, 1976

[54] METHOD AND APPARATUS FOR DELIVERING CONSTANT WATER FLOW RATES TO A FIRE HOSE AT EACH OF A PLURALITY OF SELECTABLE FLOW RATE SETTINGS

[75] Inventors: George R. Nelson, Jr., New York; Herman Kaplan, Great Neck, both of N.Y.

[73] Assignee: Grumman Aerospace Corporation, Bethpage, N.Y.

[22] Filed: Feb. 14, 1975

[21] Appl. No.: 550,044

[52] U.S. Cl. ..... 169/43; 169/24; 251/131; 417/28
[51] Int. Cl.[2] ..... A62C 27/00
[58] Field of Search ..... 169/24, 13, 43; 251/131; 239/172; 417/26, 28, 282, 300

[56] References Cited

UNITED STATES PATENTS

| | | | |
|---|---|---|---|
| 3,154,670 | 10/1964 | Gossel | 251/131 X |
| 3,322,350 | 5/1967 | Heinicke et al. | 239/172 |
| 3,613,070 | 10/1971 | Jones | 251/131 X |
| 3,762,478 | 10/1973 | Cummins | 169/24 |
| 3,786,869 | 1/1974 | McLoughlin | 169/24 |
| 3,814,541 | 6/1974 | Dent et al. | 417/28 X |

*Primary Examiner*—Evon C. Blunk
*Assistant Examiner*—Michael Mar
*Attorney, Agent, or Firm*—Morgan, Finnegan, Pine, Foley & Lee

[57] ABSTRACT

A method and apparatus for delivering constant water flow rates to the fire hose of a pumper truck at each of a plurality of selectable flow rate settings including the steps of transmitting a digital signal corresponding to a particular fire hose and pumper truck, receiving and decoding the digital signal, activating a multi-position valve in response to the decoded signal to set a particular valve position, and maintaining a constant flow rate to the fire hose by automatically varying the valve position in response to changes in the output pressure of the pump and pressure drop in the fire hose.

8 Claims, 9 Drawing Figures

METHOD AND APPARATUS FOR DELIVERING CONSTANT WATER FLOW RATES TO A FIRE HOSE AT EACH OF A PLURALITY OF SELECTABLE FLOW RATE SETTINGS

The present invention relates to a system for delivering water to the fire hoses of a fire engine, and more particularly to a method and apparatus for delivering constant water flow rates to a fire hose at each of a plurality of selectable flow rate settings.

Generally, existing systems for delivering water to the fire hoses of a fire engine utilize voice or hand signal commands from a nozzleman to a fireman positioned at the fire engine pumper. The voice commands may be simply shouted to the fireman at the pumper, or the nozzleman and pumper fireman may communicate via transmitter-receivers. Such systems are prone to human error resulting in incorrect water flow delivery and delay. Moreover, such systems require that a fireman be stationed at the pumper.

Various other known systems which enable the nozzleman to signal the fireman at the pumper are disclosed in U.S. Pat. No. 123,355, issued to Mumler (electrically activated gong), U.S. Pat. No. 578,716, issued to Buchtel (telegraphic signalling), and U.S. Pat. No. 710,246, issued to Buchtel (electrically activated gong and pulsation).

More recently various other systems for delivering water to the fire hoses of a fire truck have been disclosed. U.S. Pat. No. 3,599,722, granted to Davidson et al. discloses a boom-supported fire fighting apparatus in which the nozzle position, flow rate, and spray pattern are remotely controlled by a fireman at the fire engine pumper. U.S. Pat. No. 3,786,869, issued to McLoughlin, discloses a nozzle pressure control system including a tramsmitter located at the nozzle and a receiver located at the fire truck pumper which receives signals from the transmitter to control nozzle pressure.

It is an object of the present invention to provide constant flow rates to a fire hose at each of a plurality of selectable flow rate settings.

It is a further object of the present invention to enable the nozzleman to directly control the flow rate settings.

It is a further object of the present invention to provide a plurality of discrete settings for flow rate control.

It is a still further object of the present invention to provide a flow control system in which the flow rate is reduced in increments in an effort to establish equilibrium during a reduction in water.

It is a still further object of the present invention to provide a nozzle flow control system for fire engines which overcomes the disadvantages of the prior art systems.

Other objects, aspects and advantages of the present invention will be apparent when the detailed description is considered with the drawing.

Briefly, the present invention includes the method and apparatus for transmitting a digital signal corresponding to a particular fire hose and pumper truck, receiving and decoding the digital signal, activating a multi-position valve in response to the decoded signal to set a particular valve position, and maintaining a constant flow rate to the fire hose by automatically varying the valve position in response to changes in the pump output pressure and pressure drop in the fire hose. Advantageously, the flow rate is automatically decremented in discrete quantities during engine overspeed and pump cavitation in an effort to re-establish equilibrium.

The present invention is illustrated in the drawings, in which.

Figure 1:
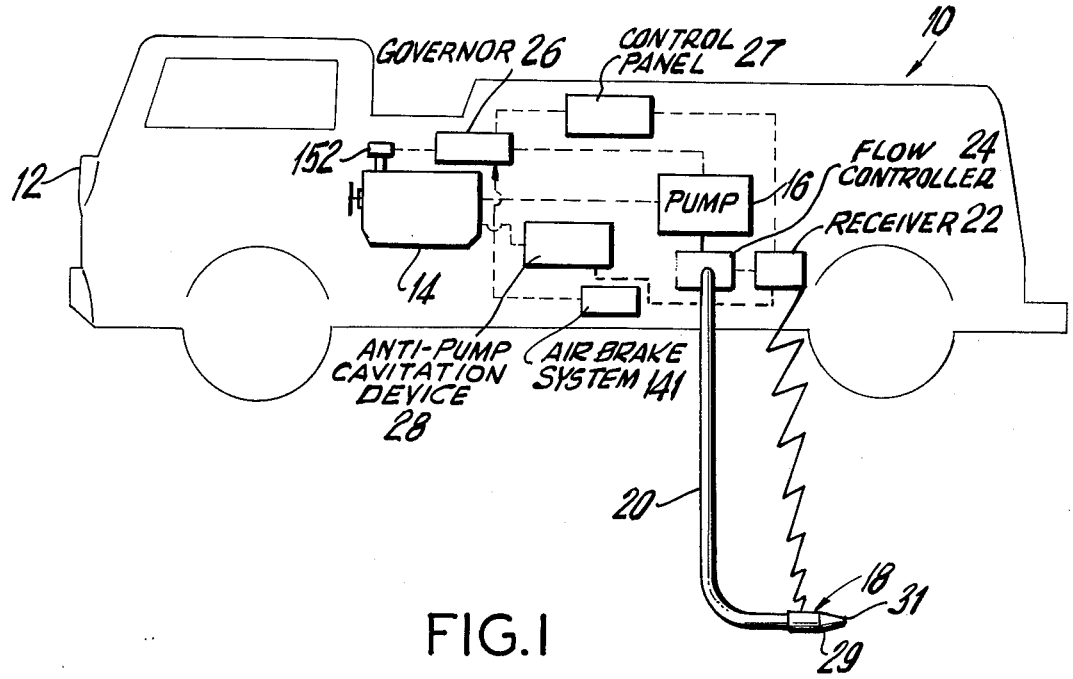
FIG. 1 is a block diagram of the fire hose flow rate control system as used in a pumper truck

Referring to FIG. 1, the fire hose flow rate control system is generally indicated at 10. The system 10 is mounted on a fire truck 12 for use in conjunction with the engine 14 and pump 16. The system 10 includes a remote digital encoder-transmitter 18 mounted at the nozzle end of a fire hose 20, a receiver 22 mounted on the fire truck 12, a flow controller 24 electrically coupled to the receiver 22 and mechanically coupled to the pump 16, a governor 26 mechanically coupled to the engine 14, and a control panel 27 which is mechanically and electrically coupled to the governor 26, receiver 22, and the fire truck 12. Advantageously, anti-pump cavitation means 28 may be coupled between the engine 14 and the flow controller 24.

The encoder and transmitter indicated at 18 is mounted on a nozzle coupler switch 29 which mechanically couples the hose 20 to the hose nozzle 31, see FIG. 1. Preferably, the nozzle coupler switch 29 is of the type disclosed in copending Ser. No. 550,041 filed on Feb. 14, 1975, and assigned to the same assignee as the present application.

The digital encoder and control 30 is electrically connected to switches 32. A battery pack e.g., including nickel cadmium batteries, energizes the digital encoder and control 30 through the switches 32. The output of the digital encoder and control 30 is coupled to the transmitter indicated in dotted outline at 36.

Figure 2:
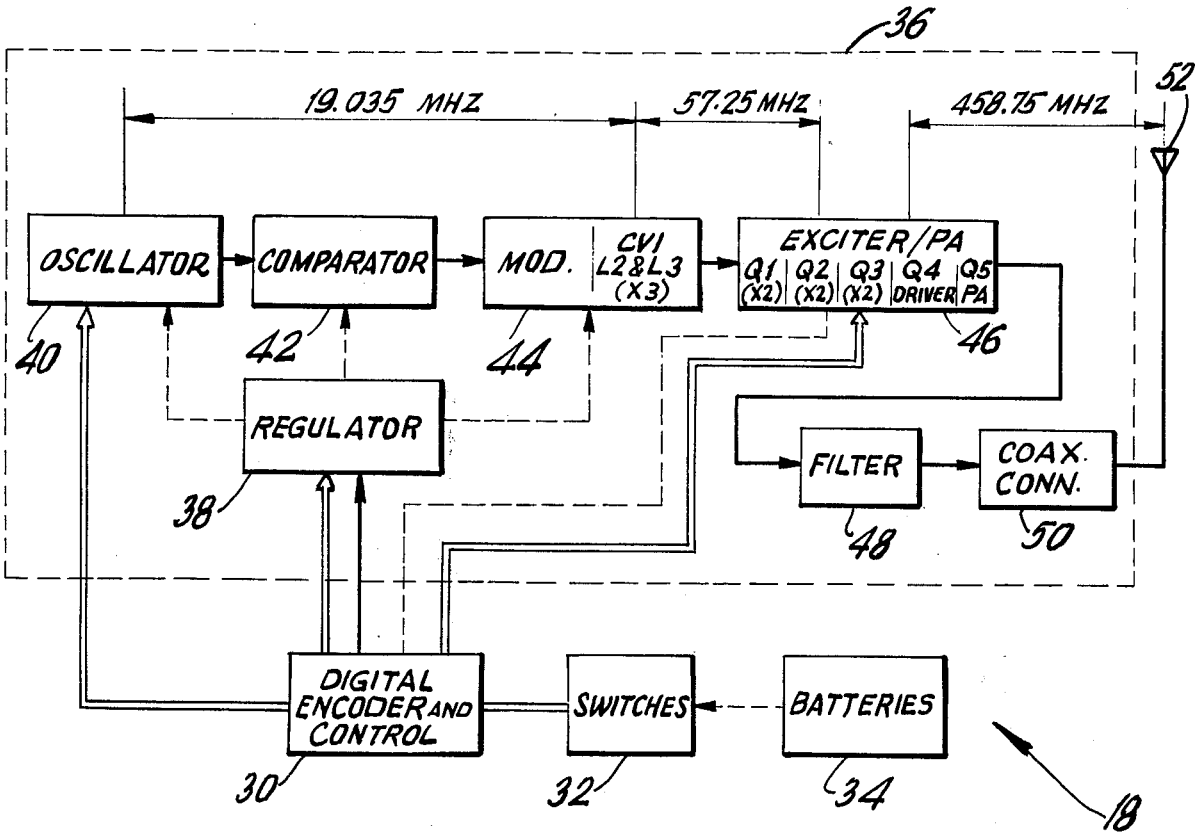
FIG. 2 is a block diagram of the encoder and transmitter.

Referring to FIG. 2, the transmitter 36 is a crystal controlled frequency modulated transmitter in the 450–470 MHz band, and is assembled using the transmitter portion of the commercially available General Electric PE Model 45R. The transmitter 36 includes a voltage regulator 38, an oscillator 40, a compensator 42, a modulator 44, exciter/PA 46, and filter 48. Advantageously, a coaxial connector 50 is provided to electrically couple the output of the filter 48 to the transmitter antenna 52. A monople quarter wave antenna is suitable, such as Model No. PRD6 from Antenna Specialists Company.

Figure 3:
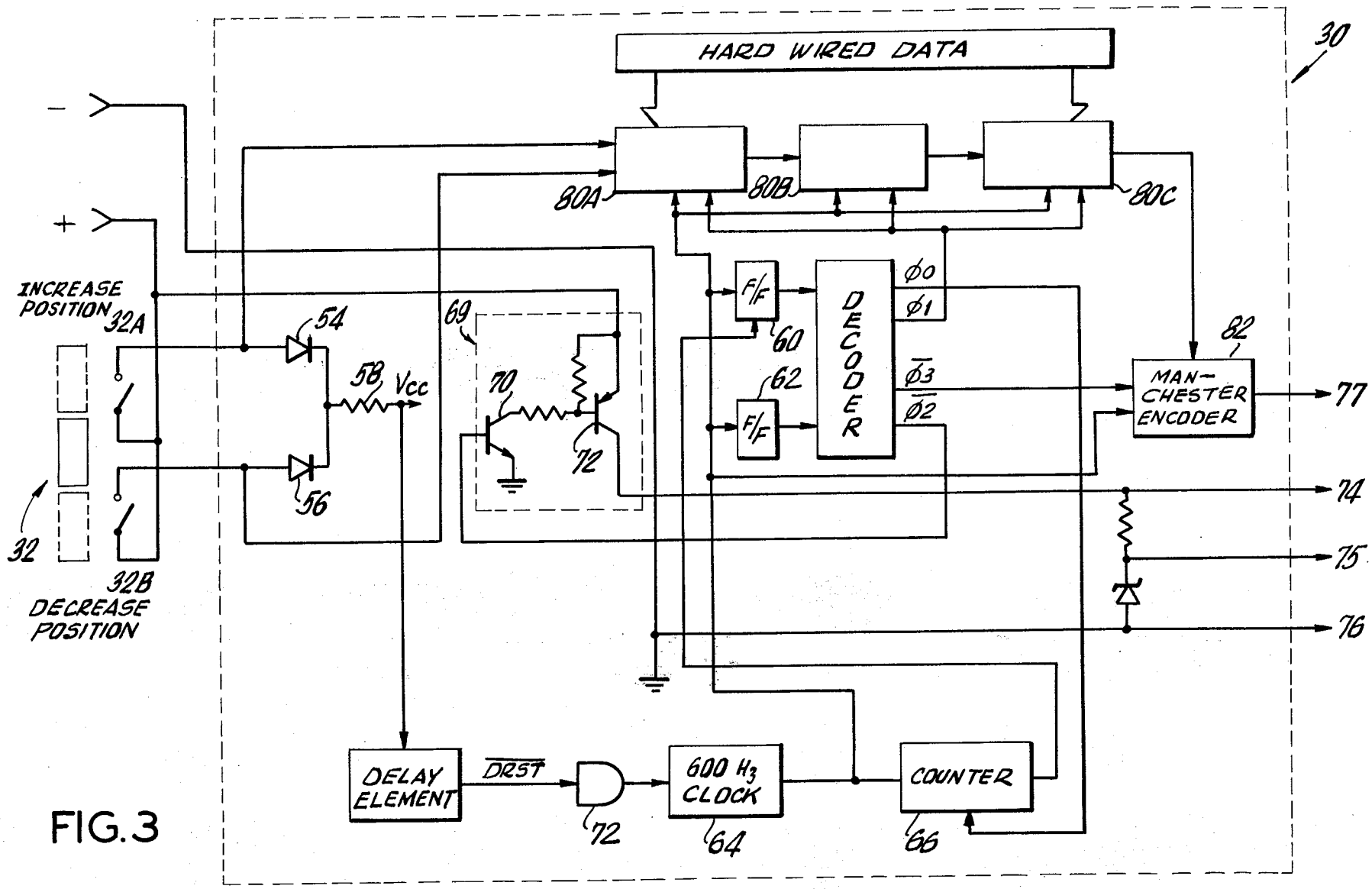
FIG. 3 is a detailed block diagram of the encoder.

Referring to FIG. 3, the switches 32 are shown as an increase position switch 32A and a decrease position switch presence When one of the switches 32 is closed, current from the battery pack 34 (13.2 volts) is transmitted to the encoder 30 through switch 32A or 32B, diode 54 or 56, and through resistance 58 to develop $V_{cc}$. The presence of $V_{cc}$ causes phase state flip-flops 60 and 62 to be reset to the $\phi$ state by a DRST signal from clock 64. The $\phi$ signal resets a counter 66. At this time a solid state switch 69 including transistor 70 (NPN) and transistor 72 (PNP) is rendered conductive by the presenc of $\overline{\phi 2}$ which is a logic 1. Power is thus supplied to the transmitter 36 through leads 74, 75, and 76 coupled to the regulator 38 and exciter/PA 46, respectively. Since $\overline{\phi 3}$ is also a logic 1, a steady logic 0 modulation is sent along lead 77 to the oscillator 40 of the transmitter 36. As the DRST voltage signal reaches the threshold of gate 78, the 600 Hz clock 64 is enabled. Flip flop 60 is set under control of the clock 64 and $\phi 1$ becomes logic 1. The hard wired data, including a preamble, truck address, hose address, data bit, and parity bit is loaded into the shift registers 80A, B, and C. The counter 66 is advanced by one digit and a logic 0 modulation is maintained on lead 77.

The next pulse from clock 64 sets flip-flop 62 and $\overline{\phi 3}$ becomes logic 0. In this phase state ($\phi$ 3), the data is shifted serially out of the registers 80A, B, and C. The counter 66 is advanced with each clock pulse. The outgoing DATA is combined with the CLK signal by a Manchester encoder 82 to form a Manchester coded message.

When the counter 66 reaches a count of 24, flip-flop 60 is reset and $\phi$ 2 is entered. $\overline{\phi 2}$, now a logic 0, turns off the solid state switch 69 and de-energizes the transmitter 36. The encoder 30 remains in the phase state $\phi$ 2, until switch 32A or 32B is opened, de-energizing the encoder 30.

The aforementioned sequence is always followed by the encoder 30; the only exception occurs when neither or both of the INCREASE and DECREASE signals are present during the $\phi$ 1 state. When this latter sequence occurs, the encoder 30 advances directly to the $\phi$ 2 state, skipping the $\phi$ 3 state, so that no message is transmitted to the transmitter 36. Thus, the transmission of erroneous data to the transmitter 36 is avoided.

Referring again to FIG. 2, the regulator 38 provides a regulated 5.4 volts to the oscillator 40, compensator 42, and modulator 44 while the encoder 30 is energized via the battery pack 34. The oscillator 40 may be a crystal-controlled Colpitts oscillator with a frequency ranging between 18.75 to 19.58 MHz. The frequency is multiplied 24 times to arrive at a 450 to 470 MHz carrier frequency. The compensator 42 includes a buffer amplifier and temperature compensating network for the oscillator 40. The modulator 44 includes a buffer which provides amplification and a frequency tripler.

The exciter/PA 46 includes three Class C doubler stages, a class C driver stage, and a class C power amplifier stage. The low pass filter 48 provides for suppression of harmonics.

Figure 4:
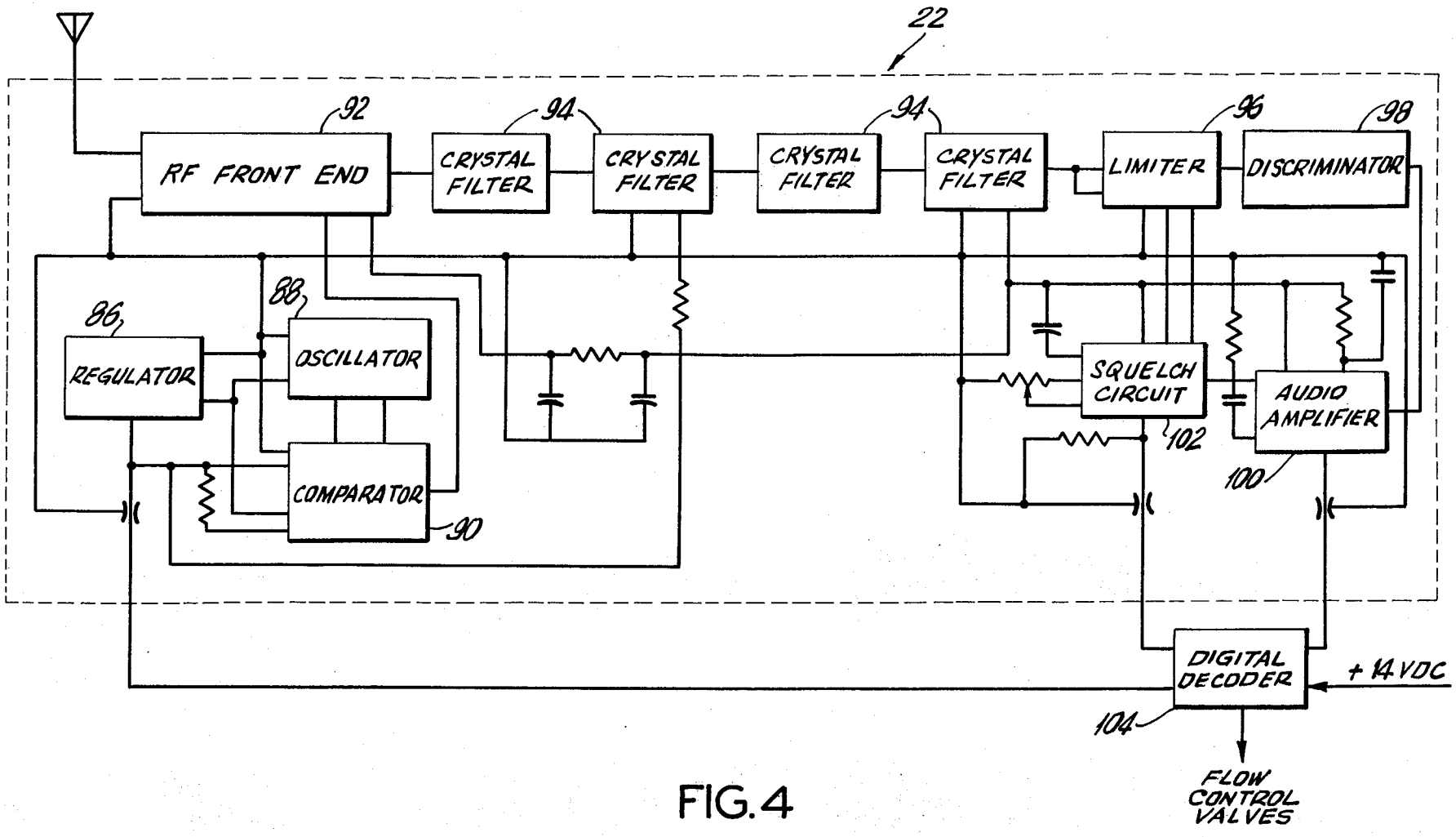
FIG. 4 is a block diagram of the receiver and decoder.

Referring to FIG. 4, the receiver 22 is a crystal controlled single conversion, super heterodyne FM receiver in the 450–470 MHz band. Such a receiver is assembled utilizing the receiver modules of the commercially available General Electric Transceiver PE Model 45R. The receiver includes a voltage regulator 86, oscillator 88, compensator 90, RF front end 92, crystal filters 94, limiter 96, discriminator 98, audio amplifier 100, including an active low pass filter, and squelch circuit 102. The RF front end 92 includes three tuned helical resonators and an RF amplifier state. The operation of such a receiver 22 is well known in the art and will not be described in detail. The antenna 103 may be monopole quarter wave antenna such as Model No. ASP G 95 from the Antenna Specialists Company.

The output of the receiver 22, specifically the audio amplifier 100, is electrically coupled to a digital decoder 104 which receives the digital output signal from the receiver 22. The fire truck battery (not shown) at 14 volts d.c. supplies the power to the receiver 22 and decoder 104. A regulator 106 in the decoder 104 supplies 6.2 VDC and 12.5 VDC to the receiver 22.

Figure 5:
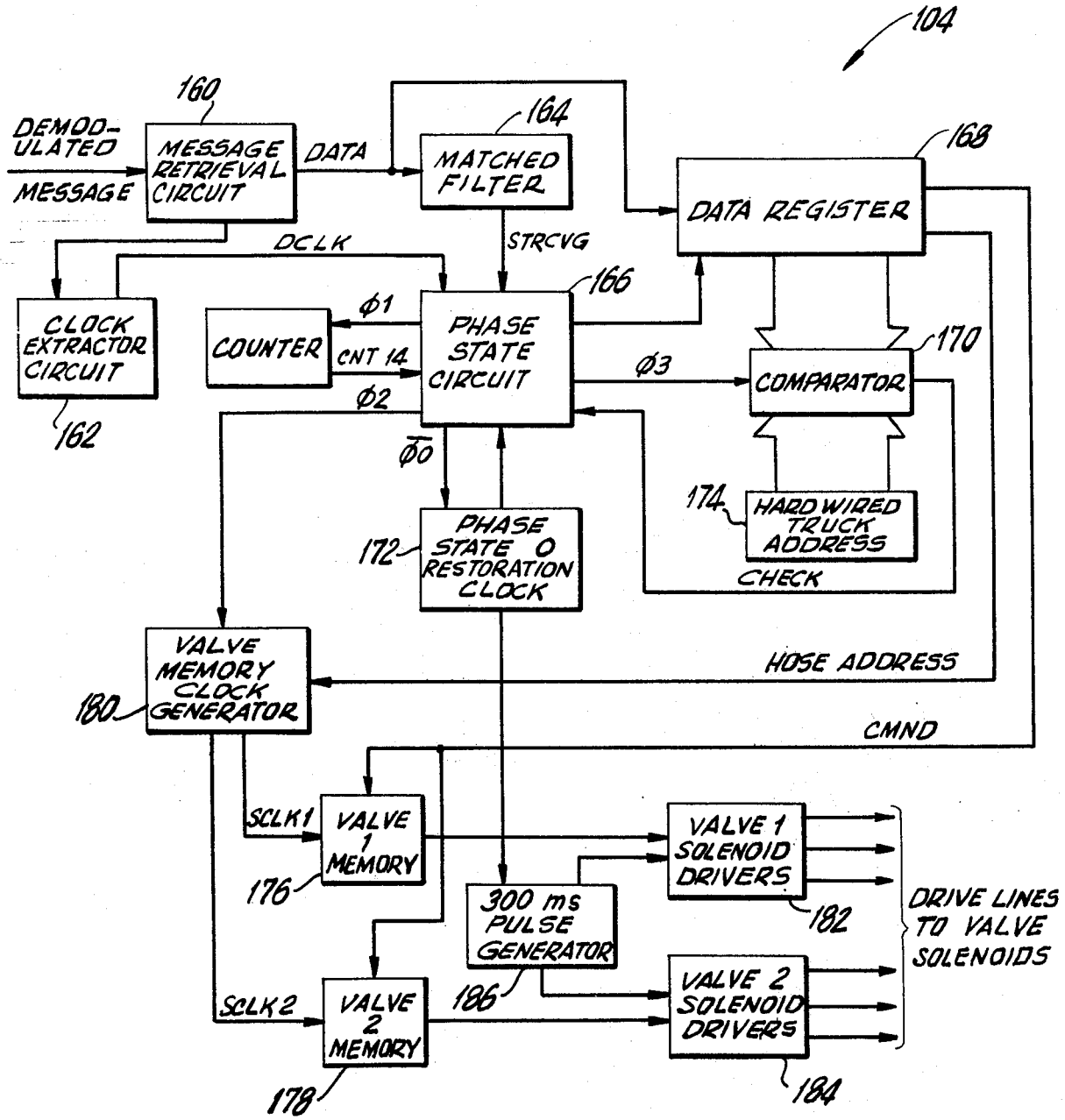
FIG. 5 is a detailed block diagram of the decoder.

Referring to FIG. 5, the received and demodulated message is applied to the decoder 104 from the RF receiver 22. This signal is amplified and squared by message retrieval circuitry 160. The data clock information (DCLK) is retrieved from the received Manchester coded message by a clock extractor circuit 162.

The DATA sequence resulting from the message retrieval circuitry 160 is transmitted to a matched filter 164. The matched filter 164 is responsive to a DATA pattern, e.g., 0110, which is contained at the end of the preamble. When this DATA pattern is received, a start receiving (STRCVG) signal is generated by the matched filter 164. When this occurs phase state circuitry 166 is advanced to phase state 1.

In phase state 1, the phase state circuitry 166 applies a shift register clock signal (SRCLK) to the clock input of a data register 168. The incoming DATA from the message retrieval circuitry 160 is shifted into the data register 168 serially and synchronously with the SRCLK signal.

Upon leaving phase state 0, a phase state restoration clock 170 is enabled to transmit a 350 millisecond pulse. At the end of this pulse, if the phase state circuitry 166 has not reverted to phase state 0, it is reset to phase state 0.

When 14 bits of DATA have been received in phase state 1, the phase state circuitry 166 advances to phase state 3. The 14 data bits contain the 10 bit truck address, 2 bit hose address, 1 bit of data (increase or decrease), and a parity bit. The truck address and parity bit are tested in phase state 3. The received truck address is compared in a comparator 172 with the hard wired address 174 of the receiver 22. If there is no match, there is no output signal from the comparator 172 and the phase state circuitry 166, and therefore the data register 168, is not enabled. The meassage is disregarded by the decoder 104 and phase state 0 is entered with the next DCLK signal. The decoder 22 then waits for the next STRCVG signal to be generated by the matched filter 164, indicating the beginning of another message.

If the truck addresses and parity bits match, a CHECK signal is generated by the comparator 172 and phase state 2 is entered, indicating a valid command has been received and recognized. There are only two possible commands: an increase or decrease in the water flow rate. The existing valve status for valves 1 and 2 (assuming a two hose truck with one valve 106 for each hose) is stored in valve 1 memory 176 and valve 2 memory 178. As $\phi$ 2 goes to a logic 1 level, SCLK 1 or SCLK 2 is generated by the valve memory clock generator 180 depending upon which valve is addressed. The SCLK 1 or 2 signals serve as the clock signals for the valve memories 176 or 178 (binary up/-down counter). The addressed valve memory 176 or 178 increases or decreases by one count under control of the CMND signal from the data register 168.

To place the proper valve into the new flow status, 300 millisecond drive pulses are simultaneously applied to solenoid drivers 182 and 184 from a pulse generator 186.

The appropriate valve solenoids receive an actuating drive pulse of 300 millisecond duration to place them in the desired position. The drive pulses terminate when at the end of 300 milliseconds the phase state 0 restoration clock 172 resets the phase state circuitry 172 to the 0 state. The decoder 104 then waits for the next STRCVG signal.

Figure 6A:
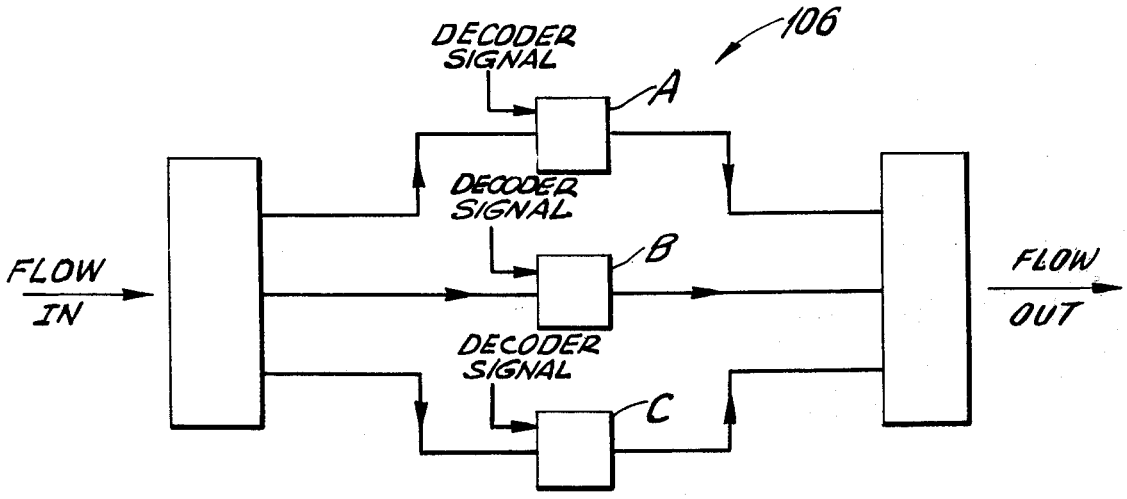
FIG. 6A is a block diagram of the multi-position control valve.
Figure 6B:
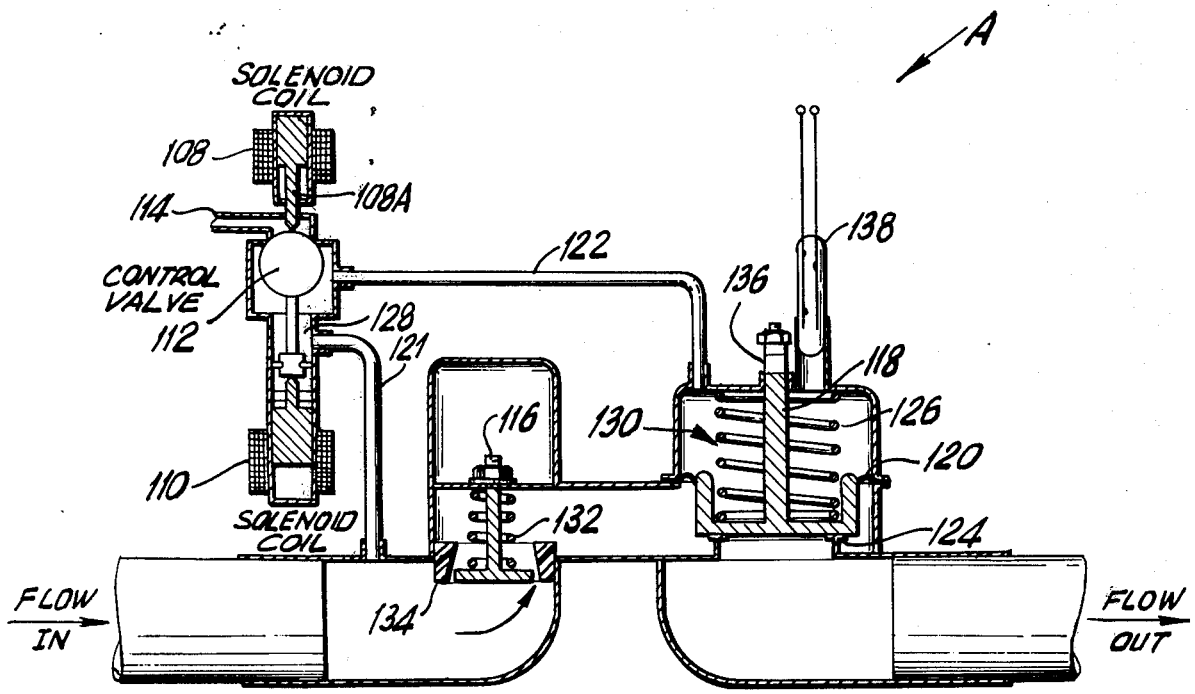
FIG. 6B is a side elevation of the multi-position control valve.

Referring to FIG. 6A, the output from the digital decoder 104 is applied to the flow control valve 106 for the proper hose 20. The flow control valve 106 includes three constant flow sections A, B, and C, having common inlets and outlets, whose flows may be combined to obtain different flow rates. Such a multi-position flow control valve is available from A. Research Manufacturing Co. as Model No. SCCAD-012-100-1. Section A of the flow control valve 106 is illustrated in FIG. 6B; the other sections, B and C, are identical and will not be described. Preferably Section A has a flow rate of 45 GPM, section B a flow rate of 90 GPM, and section C a flow rate of 175 GPM. Thus, with various combinations of sections A, B, and C, the following flow rates can be obtained: 45, 90, 135, 175, 220, 265, and 310 GPM.

The output drive signals from the decoder 104 are transmitted to the solenoid coils 108 or 110 depending upon whether the nozzleman has signaled for more or less water flow (INCREASE OR DECREASE). In FIG. 6B, section A, the control valve 112 is shown in the closed position; closing solenoid 110 is momentarily energized. With the flow control valve 112 closed, the air vent 114 is closed and water flows through the flow control element 116 to one side of an actuator 118, including a diaphragm 120. Further, water flows through conduit 121 to the control valve 112 and through linking conduit 122 to apply a force to the other side of the actuator 118 and diaphragm 120. A greater force is applied to the opposite side of the actuator 118 and diaphragm 120 since the exposed area of this side is greater than that of the other side. This force combined with the force of spring 126 holds actuator 118 on its seat 124. To open section A, the solenoid coil 108 is momentarily energized by a signal from the decoder 104. The solenoid plunger 108A moves the control valve 112 downwardly, opening the vent 114 and closing the inlet 128 to the linking conduit 122. The actuator chamber 130 is vented to ambient causing a net force on the diaphragm 120 which deflects it upward and opens the actuator 118, allowing water to flow through section A. The flow control element 116 is responsive to change in the nozzle pressure drop of the flowing water. The flow control element 116 is biased by a spring 132 and moves upwardly or downwardly in accordance with changes in the pressure drop of the flowing water to vary the valve opening 134 provided by the flow control element 116 and maintain a constant output flow rate. Advantageously, a magnet 136 may be positioned on the actuator 118 to close a reed switch 138 to provide a remote indication of section operability, i.e., at the control panel 27 of the fire truck 12.

Figure 7:
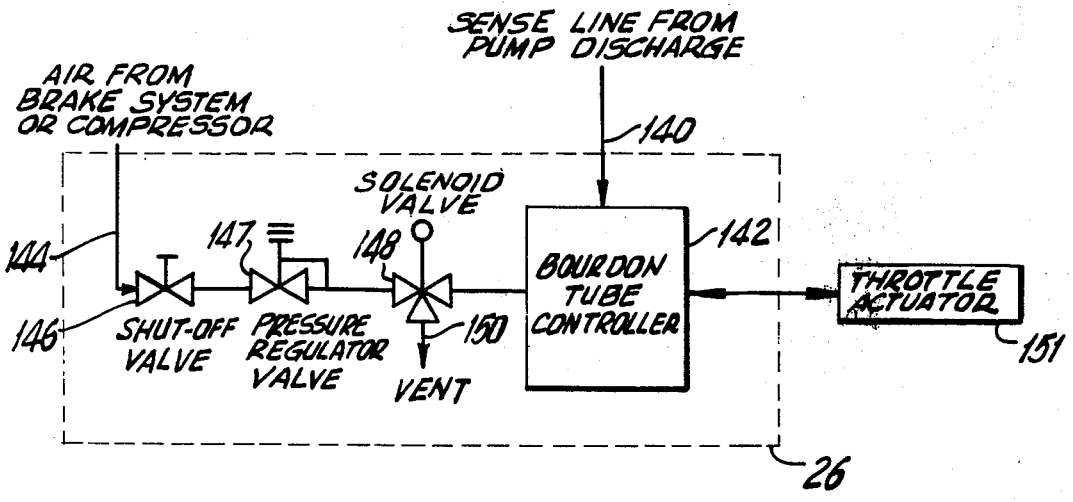
FIG. 7 is a block diagram of a governor.

Referring to FIG. 7, a governor 26 is illustrated. The governor 26 is responsive to air from the air brake system 141 of the fire truck 12. Alternatively, the air may be supplied from a separate compressor. The output from the pump 16 is sensed via a sense line 140 and applied to a controller 142. The controller 142, which may advantageously include a bourdon tube and set point flap valve, modulates air from an air sense line 144 which includes a shut-off valve 146, a pressure regulator valve 147, and solenoid valve 148, including a vent 150. The controller 142 is pneumatically coupled to a throttle actuator 151 which is mechanically coupled to the throttle 152 of engine 14.

The controller 142 monitors pump discharge pressure and compares it to the desired "set-point" pressure which is manually set at the controller 142. The pump discharge pressure modulates the air pressure signal to the throttle actuator 151, causing an increase or decrease in engine RPM until the pump discharge pressure and "set-point" pressure are equal. Any change in the demand flow rate which results in a change in the pump discharge pressure causes the controller 142 to readjust the engine RPM until the pump discharge pressure is again equal to the set-point pressure.

The air pressure from the air brake system 141 is regulated down to a usable level for the controller 142 via the pressure regulator 147 and applied to the controller 142 through the three-way solenoid valve 148. When an overspeed condition occurs due to low suction pressure, excessive flow demands, loss of water, etc., a signal from an engine speed sensor 154, see FIG. 8, de-energizes the solenoid valve 148 thereby shutting off the air supply to the controller 142 and bleeding down the controller 142 through vent 150. Loss of pressure to the throttle actuator 151 reduces the opening of the throttle 152, thereby decreasing engine RPM until the overspeed signal is removed from the solenoid 148.

Figure 8:
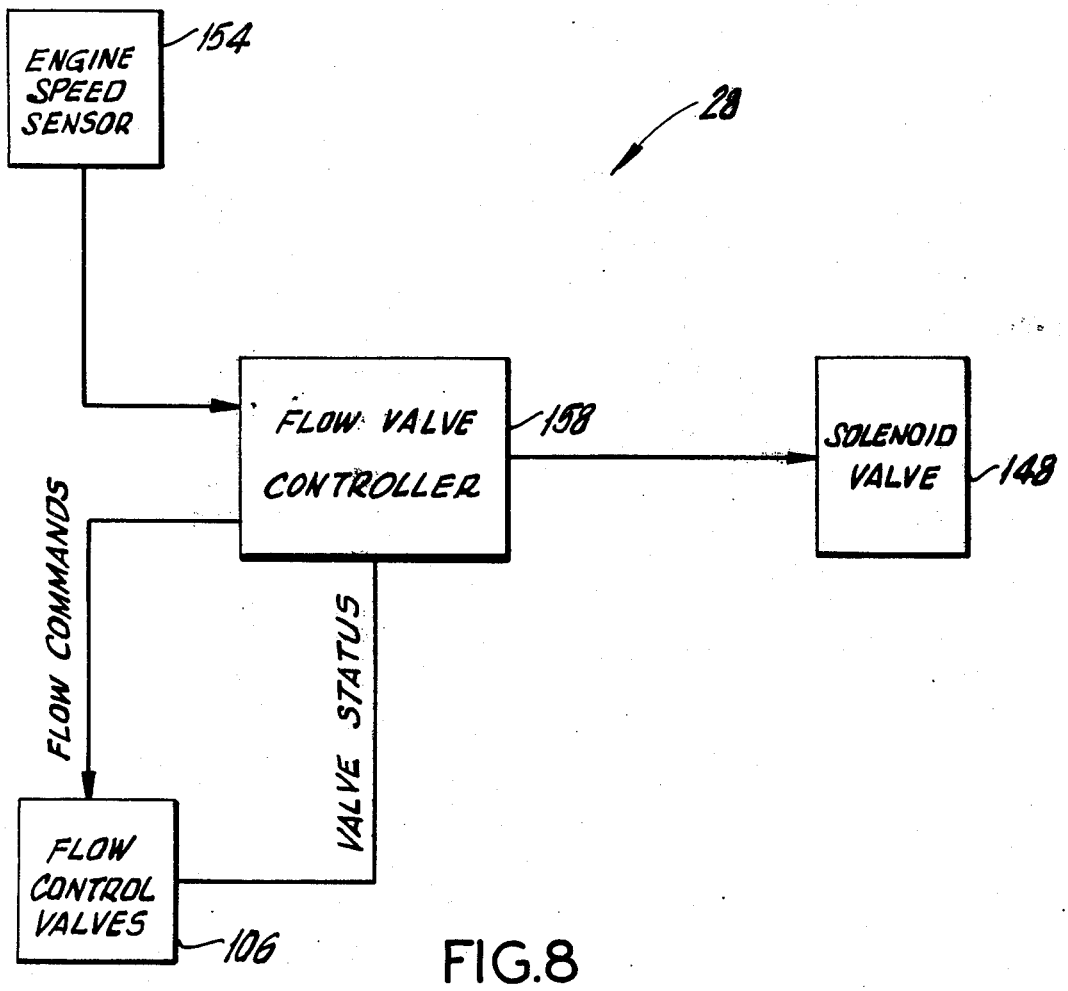
FIG. 8 is a block diagram of an anit-pump cavitation device.

Referring to FIG. 8, an anti-pump cavitation device 28 is illustrated. Preferably, this device is of the type disclosed in copending application Ser. No. 550,042 filed on Feb. 14, 1975, and assigned to the same assignee as the present application.

The anti-pump cavitation device 28 protects the pump 16 against cavitation and the engine 14 against overspeed. Lack of an adequate water supply to the fire pumper truck 12 can cause cavitation of the pump 16 and pump damage or engine overspeed and possible destruction of the engine 14. If the pump 16 is unable to deliver the "set point" pressure of the governor 26, the governor 26 sensing this condition requires more and more engine speed until a runaway engine condition exists.

With the anti-pump cavitation device 28, the engine speed sensor 154 senses an overspeed condition, e.g., above 2000 RPM, and signals a flow valve controller 158 that this condition is present. The flow valve controller 158 commands solenoid valve 148, see FIG. 7, to shut off the air supply to the controller 142 and bleed down the controller 142 through vent 150, thereby decreasing engine speed until the overspeed condition is removed. The flow valve controller 158 also commands the flow control valves 106 to reduce the flow to each hose 20 by one increment. A waiting period of 5 seconds is provided to determine whether the speed of the engine remains in this reduced state. If after 5 seconds the engine speed continues to exceed the specified maximum limit, the setting of the flow control valves 106 is reduced another increment. This procedure is repeated until the engine speed stabilizes below the preset maximum or the flow control valves 106 are completely closed. When the flow valve controllers 158 sense that the valves 106 are closed, the solenoid valve 148 is de-energized to return the throttle setting to idle.

Advantageously, a valve pulser (not shown) may be employed with the flow control valves 106 to cause the flow control valves 106 to cycle partially open and closed to induce flow surges in the water supplied to each fire hose 20. These flow surges are sensed by the nozzleman and warn him when the water flow rate is being decreased. The input to the valve pulser is supplied by any one of the following fault conditions: engine high temperature, engine low oil pressure, engine overspeed, and battery low voltage. When one of these conditions occurs, an astable circuit is energized simultaneously with the sounding of an audible alarm. The astable circuit operates at a 1 Hz rate. The pulses are sent to the decoder 104. The decoder 104, under control of the pulses from the astable circuit, causes the flow control valves 106 to cycle partially open and partially closed to cause water flow surges at the nozzles 31 of the fire hoses 20.

In operating the system of the present invention, the pump 16 is activated and the nozzleman selects the desired flow rate by moving the nozzle coupler switch 29. In response to movement of the nozzle coupler switch 29, the nozzle coupler signal is encoded by digital encoder 30 and fed to transmitter 36. The digital signal from transmitter 36 is transmitted to the receiver 22 mounted on the fire truck 12 and decoded by digital decoder 104. The decoded signal is applied to the flow control valve 106 associated with the hose from which the signal was transmitted and the flow control valve 106 opens or closes one flow increment depending on the movement of the nozzle coupler switch 29. The flow control valve 106 automatically compensates for changes in the pump output pressure or pressure drop in the hose 20 by increasing or decreasing its valve opening to provide a constant water flow to the hose. The governor 26 maintains a constant pump output pressure and the anti-pump cavitation device 28 prevents cavitation of the pump 16 when the RPM of the engine 14 passes a pre-set limit by reducing the water flow in increments in an effort to re-establish a stable condition.

Thus, it is apparent that the present invention provides a fire hose flow rate control system under the direct control of the nozzleman that ensures constant water flow rates at a plurality of flow rate settings, and is rapid and reliable in response, while safeguarding the nozzleman's retreat under conditions of lost water.

It should be understood by those skilled in the art that various modifications may be made in the present invention without departing from the spirit and scope thereof, as described in the specification and defined in the appended claims.

What is claimed is:

1. A method of delivering constant water flow rates to a fire hose of a fire pumper truck at any one of a plurality of discrete selectable flow rate settings, comprising the steps of:

transmitting a digital signal corresponding to a particular fire hose, a particular fire pumper truck, and a water flow rate;

receiving and decoding the digital signal;

activating a discrete multi-position valve having a plurality of discrete predetermined water flow rate settings with the decoded signal to set the multi-position valve for delivering a predetermined water flow rate to the fire hose; and adjusting the water flow through the multi-position valve in response to changes in input water pressure and output back pressure to the multi-position valve to maintain the predetermined water flow rate until another corresponding digital signal is transmitted, received and decoded for activating the multi-position valve.

2. The method of claim 1 including the step of:

preventing cavitation of the water pump in the fire pumper truck.

3. The method of claim 1 including the step of:

increasing or decreasing the predetermined water flow rate of the discrete multi-position valve one discrete setting upon application of a signal to the multi-position valve.

4. The method of claim 1 including the step of:

sensing the output pressure of the water pump;

comparing the sensed output pressure of the water pump with a preset pump pressure;

controlling the pump output pressure to correspond with the preset pump pressure.

5. An adjustable flow rate control system for a fire pumper truck which provides constant water flow rates to the fire hoses coupled thereto at a plurality of discrete selectable flow rate rate settings, comprising:

digital transmitting means coupled to the nozzle of each individual fire hose for transmitting a digital signal having a predetermined frequency and corresponding to a particular fire hose, a particular fire pumper truck, and a water flow rate;

receiving means in the fire pumper truck for receiving and decoding the digital signals transmitted from said transmitting means;

discrete multi-position valve means having a plurality of discrete water flow rate settings for providing a predetermined water flow rate to the proper fire hose in response to transmission of the proper digital signal from said transmitting means and receipt and decoding by said receiving means;

valve control means for controlling the movement of said multi-position valve means in response to a decoded output signal from said receiver to provide an increase or decrease in the discrete water flow rate setting in accordance with the digital signal transmitted by said digital transmitting means;

automatic flow rate control means for automatically adjusting the water flow through said multi-position valve means in response to changes in input water pressure or output back pressure to maintain a the selected discrete water flow rate to each fire hose in accordance with the setting of the multi-position valve.

6. The system of claim 5, including:

governor means for maintaining a constant output pressure at the water pump of the fire pumper truck.

7. The system of claim 5, including:

anti-pump cavitation means for preventing cavitation of the water pump of the fire pumper truck.

8. A method of delivering constant water flow rates to a fire hose of a fire pumper truck at each of a plurality of selectable flow rate settings, comprising the steps of:

transmitting a digital signal corresponding to a particular fire hose and a particular fire pumper truck;

receiving and decoding the digital signal;

activating a multi-position valve with the decoded signal to set a particular valve position with a predetermined water flow rate;

maintaining the predetermined water flow rate to the fire hose by automatically varying the valve position in response to changes in input water pressure and output back pressure to the multi-position valve;

automatically decreasing the predetermined water flow rate of the multi-position valve to a lesser predetermined water flow rate during periods of insufficient water and maintaining the lower predetermined water flow rate for a specified period of time in an effort to attain stability; and further decrementing the water flow rate one setting at a time until stability is attained.

* * * * *